United States Patent [19]

Sievert

[11] Patent Number: 5,017,049

[45] Date of Patent: May 21, 1991

[54] COMPOSITE MASONRY BLOCK

[75] Inventor: Dick J. Sievert, New Richmond, Wis.

[73] Assignee: Block Systems Inc., No. St. Paul, Minn.

[21] Appl. No.: 558,563

[22] Filed: Jul. 26, 1990

Related U.S. Application Data

[60] Division of Ser. No. 493,925, Mar. 15, 1990, which is a continuation-in-part of Ser. No. 412,272, Sep. 29, 1989.

[51] Int. Cl.[5] ..... E02D 29/02

[52] U.S. Cl. ..... 405/284; 52/604; 52/596; 405/258; 405/286; D25/114; D25/118

[58] Field of Search ..... 405/284, 286, 258, 262; 52/603, 604, 596; D25/114, 116, 118

[56] References Cited

U.S. PATENT DOCUMENTS

| | | | |
|---|---|---|---|
| 228,052 | 5/1880 | Frost . | |
| D. 237,704 | 11/1975 | Lane | D18/2 |
| D. 279,030 | 5/1985 | Risi et al. | D25/80 |
| D. 280,024 | 8/1985 | Risi et al. | D25/80 |
| D. 295,788 | 5/1988 | Forsberg | D25/113 |
| D. 295,790 | 5/1988 | Forsberg | D25/116 |
| D. 296,007 | 5/1988 | Forsberg | D25/116 |
| D. 296,365 | 6/1988 | Forsberg | D25/116 |
| D. 297,464 | 8/1988 | Forsberg | D25/114 |
| D. 297,574 | 9/1988 | Forsberg | D25/114 |
| D. 297,767 | 9/1988 | Forsberg | D25/58 |
| D. 298,463 | 11/1988 | Forsberg | D25/114 |
| D. 299,067 | 12/1988 | Forsberg | D25/58 |
| D. 299,069 | 12/1988 | Forsberg | D25/157 |
| D. 300,253 | 3/1989 | Forsberg | D25/114 |
| D. 300,254 | 3/1989 | Forsberg | D25/114 |
| 566,924 | 9/1896 | Morrin . | |
| 810,748 | 1/1906 | Haller et al. . | |
| 1,092,621 | 4/1914 | Worner . | |
| 1,414,444 | 5/1922 | Straight . | |
| 1,419,805 | 6/1922 | Bigler . | |
| 1,456,498 | 5/1923 | Binns . | |
| 1,733,790 | 10/1929 | Gilman . | |
| 1,907,053 | 5/1933 | Flath . | |
| 2,094,167 | 9/1937 | Evers . | |
| 2,197,960 | 4/1940 | Alexander | 61/47 |
| 2,235,646 | 3/1941 | Schaffer | 72/101 |
| 2,313,363 | 3/1943 | Schmitt | 405/286 |
| 2,371,201 | 3/1945 | Wells | 72/38 |
| 2,882,689 | 4/1959 | Huch et al. | 61/35 |
| 2,963,828 | 12/1960 | Belliveau | 50/425 |
| 3,036,407 | 5/1962 | Dixon | 50/443 |
| 3,274,742 | 9/1966 | Paul et al. | 52/245 |
| 3,390,502 | 7/1968 | Carroll | 52/424 |
| 3,430,404 | 3/1969 | Muse | 52/439 |
| 3,557,505 | 1/1971 | Kaul | 52/275 |
| 3,783,566 | 1/1974 | Nielson | 52/232 |
| 3,936,987 | 2/1976 | Calvin | 52/309 |
| 3,995,434 | 12/1976 | Kato et al. . | |
| 4,001,988 | 1/1977 | Riefler | 52/125 |
| 4,016,693 | 4/1977 | Warren | 52/405 |
| 4,098,040 | 7/1978 | Riefler | 52/125 |

(List continued on next page.)

FOREIGN PATENT DOCUMENTS

| | | | |
|---|---|---|---|
| 1188116 | 6/1985 | Canada | 405/286 |
| 1811932 | 11/1968 | Fed. Rep. of Germany . | |
| 2755833 | 12/1977 | Fed. Rep. of Germany . | |
| 1360872 | 4/1964 | France . | |
| 336 | of 1871 | United Kingdom . | |
| 1385207 | 2/1975 | United Kingdom . | |
| 2127872 | 4/1984 | United Kingdom . | |

OTHER PUBLICATIONS

Catalog sheet "The Allan Block Advantage". (date unknown).

Technical Data Sheet "AZTECH TM Wall System". Anchor Block Co./Oscar Roberts Concrete Products Co. (circa. Jan. 1989).

(List continued on next page.)

*Primary Examiner*—Dennis L. Taylor

*Attorney, Agent, or Firm*—Merchant, Gould, Smith, Edell, Walter & Schmidt

[57] ABSTRACT

Disclosed is a composite masonry block comprising a substantially rectangular body having a bevelled surface and an interlocking flange. Also disclosed are structure made form the masonry block and methods of making the block.

12 Claims, 3 Drawing Sheets

U.S. PATENT DOCUMENTS

| | | | |
|---|---|---|---|
| 4,107,894 | 8/1978 | Mullins | 52/593 |
| 4,110,949 | 9/1978 | Cambiuzzi et al. | 52/437 |
| 4,186,540 | 2/1980 | Mullins | 52/593 |
| 4,187,069 | 2/1980 | Mullins | 425/470 |
| 4,207,718 | 6/1980 | Schaaf et al. | 52/585 |
| 4,218,206 | 8/1980 | Mullins | 425/253 |
| 4,228,628 | 10/1980 | Schlomann | 52/438 |
| 4,229,123 | 10/1980 | Heinzmann | 405/273 |
| 4,288,960 | 9/1981 | Auras | 52/604 |
| 4,312,606 | 1/1982 | Sarikelle | 405/286 |
| 4,314,431 | 2/1982 | Rabassa | 52/259 |
| 4,335,549 | 6/1982 | Dean | 52/98 |
| 4,337,605 | 7/1982 | Tudek | 52/293 |
| 4,426,815 | 1/1984 | Brown | 52/100 |
| 4,490,075 | 12/1984 | Risi et al. | 405/273 |
| 4,496,266 | 1/1985 | Ruckstuhl | 404/41 |
| 4,512,685 | 4/1985 | Hegle | 405/284 |
| 4,524,551 | 6/1985 | Scheiwiller | 52/98 |
| 4,572,699 | 2/1986 | Rinninger | 404/42 |
| 4,640,071 | 2/1987 | Haener | 52/286 |
| 4,660,342 | 4/1987 | Salisbury | 52/358 |
| 4,711,606 | 12/1987 | Leling et al. | 405/286 |
| 4,726,567 | 2/1988 | Greenberg | 256/19 |
| 4,802,320 | 2/1989 | Forsberg | 52/585 |
| 4,896,999 | 1/1990 | Ruckstuhl | 405/286 |

OTHER PUBLICATIONS

Technical Data Sheet for "DIAMOND TM Wall System", Anchor Block Co./Oscar Roberts Concrete Products Co. (circa. Jan. 1989).

DIAMOND TM Installation Guide, American Masonry Products (circa. Jan. 1985).

Drawing, "Revetment Block", Columbia Machine, Inc. (1/6/78).

Standard Load Bearing Wall Tile p. 11, The Hollow Building Tile Assoc. 1/1924.

"Modular Concrete Block"; Besson Co. Bulletin (Feb. 1985).

"Paving Stone—New World Look with Old World Charm".

"IVANY Block Retaining Walls".

"The Estate Wall by Unilock", Unilock Chicago Inc.

"Pisa II", Interlocking Retaining Wall Supplies for Garden Landscaping.

Kiltie Corp., *Versa-Lok TM Retaining Wall Systems* brochure (date unknown).

Johnson Block & Ready Mix Company, Inc., *Johnson Block Retaining Wall System* brochure (date unknown).

Rockwood Retaining Wall Systems, Inc. *EZ Wall Systems* brochure (date unknown).

Weiser Concrete, Inc., Weiser Slope Blocks advertisement (date unknown).

Handy Stone TM, a division of Kiltie Corp. of No. St. Paul, MN, Handy Stone TM product literature.

FIG.7
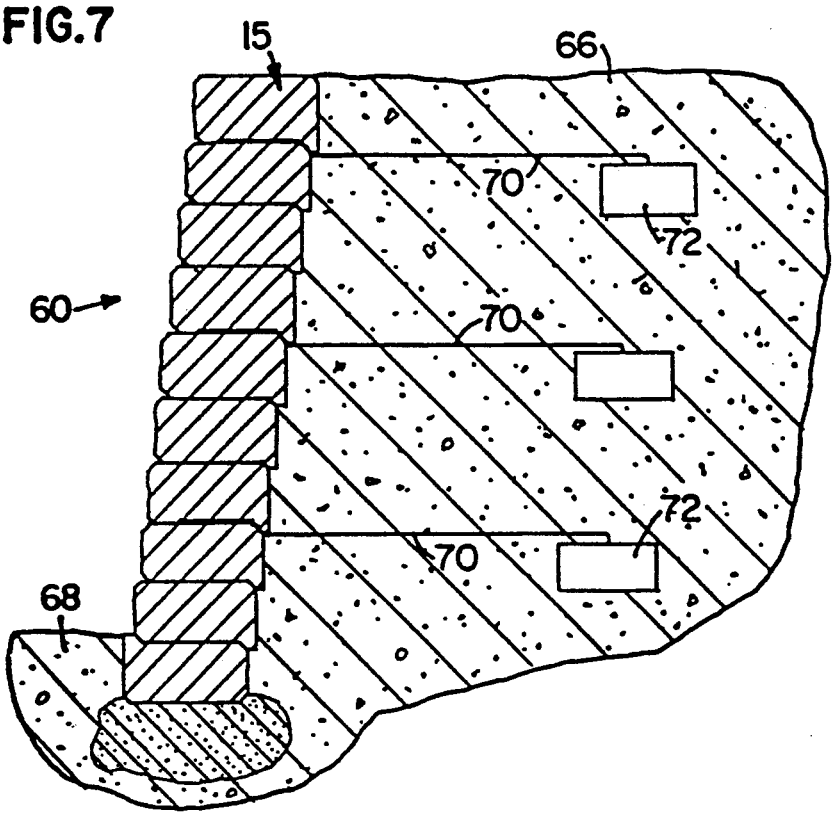
FIG. 8
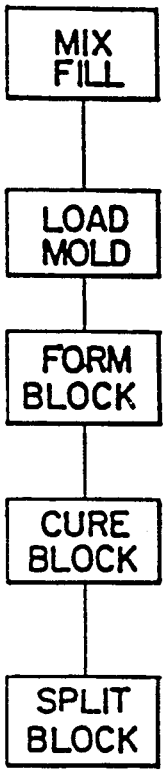
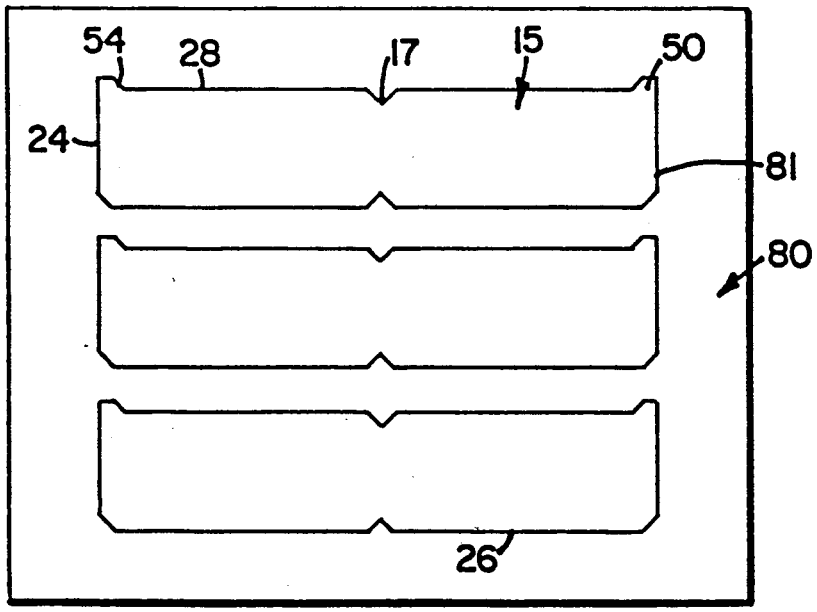
FIG.9

COMPOSITE MASONRY BLOCK

This application is a divisional application of U.S. patent application Ser. No. 493,925 filed Mar. 15, 1990 which was a continuation-in-part of U.S. patent application Ser. No. 412,272 filed Sept. 29, 1989.

FIELD OF THE INVENTION

This invention relates generally to masonry blocks which may be used in the construction of landscaping elements. More specifically, the present invention relates to composite masonry blocks which are cast on their sides and which may be used to construct structures such as stairs and retaining walls with minimal setback.

BACKGROUND OF THE INVENTION

The construction of residential and commercial structures as well as the development of usable space has led to the use a variety of devices to overcome the natural contour of the land. Often times the most desirable locations in which to build a dwelling or other structure are those which have the most severe landscape. Wooded ravines, sloping hillsides, and cliffs which overlook rivers, lakes, and the like are all examples of naturally occurring landscapes which must often be overcome prior to the construction of a structure. In addition to the construction of buildings, the development of usable land in yards, playgrounds, lots, etc. also often requires the artificial contouring of the landscape.

While many structural elements have been used to artificially contour or define the landscape, retaining walls have been developed as a common means of supporting, holding back, or otherwise altering the condition of the landscape. Generally, a retaining wall is a physical structure which rises above the plane of the landscape on one side of the wall to meet an adjacent but more highly positioned soil on the opposite side of the wall.

Retaining walls may be formed from any number of materials including steel or other metal alloys, wood, or block among other material. One material which has received wide and popular acceptance for use in the construction of retaining walls and the like is molded masonry blocks. Blocks used for these purposes include those disclosed by Risi et al, U.S. Pat. Nos. 4,490,075 and Des. 280,024 and Forsberg, 4,802,320 and Des. 296,007 among others. Blocks have also been patterned and weighted so that they may be used to construct a wall which will stabilize the landscape by the shear weight of the blocks. These systems are often designed to "setback" at an angle to counter the pressure of the soil behind the wall. Setback is generally considered the distance in which one course of a wall extends beyond the front of the next highest course of the same wall. Given blocks of the same proportion, setback may also be regarded as the distance which the back surface of a higher course of blocks extends backwards in relation to the back surface of the lower wall courses. In vertical structures such as retaining walls, stability is dependent upon the setback between structures courses and the weight of the blocks.

For example, Schmitt, U.S. Pat. No. 2,313,363 discloses a retaining wall bleek having a tongue or lip which secures the block in place and provides a certain amount of setback from one course to the next. The thickness of the Schmitt tongue or lip at the plane of the lower surface of the block determines the setback of the blocks. However, smaller blocks for use in residential applications and the like have to be made with smaller tongues or flanges in order to avoid compromising the structural integrity of the wall with excessive setback. However, manufacturing smaller blocks having smaller tongues using conventional techniques does not result in a block tongue or lip having adequate structural integrity. Concurrently, reducing the size of the tongue or flange may weaken and compromise this element of the block, the course, or even the entire wall.

Other problems often occur which prevents the production of blocks having a simple design capable of being used in both residential and commercial markets. For instance, blocks may be made individually but this is generally far too expensive for most applications. More commonly, composite masonry blocks are generally formed by block machines upside down, i.e. on their back. The compressive forces applied to the wet fill during casting in combination with the moisture present between compression head and the fill often prevents the clean definition of interlocking elements having a small enough proportion to provide minimal setback between the layers or courses of the wall. In turn, excessive setback compromises the stability of the structure and prevents the simple construction of walls without ancillary support systems.

One means of achieving minimal setback is by pinning or staking the blocks of a higher course to the previously placed blocks of a lower course as shown in Forsberg. However, the use of pin systems is often complex requiring the close supervision of laborers. Such an investment in time and manpower is often not supportable given the costs at which landscaping services are sold. Moreover, the omission or misplacement of pins from the blocks can compromise the structural integrity of the entire wall.

As can be seen the present state of the art of forming masonry blocks as well as the design and use of these blocks to build structure has definite shortcomings.

SUMMARY OF THE INVENTION

The present invention provides a method for casting composite masonry blocks which allows for minimum setback while ensuring the fabrication of blocks having flanges or locking elements of minimal size and optimal structural integrity. In the most preferred mode, the block of the present invention is suitable for residential use providing vertical structures of high stability while also having minimal size and setback. The present block also retains a flange which by its very composition and physical size provides an effective locking mechanism once the blocks are used. In use, the blocks of the present invention provide structures such as retaining walls which do not require the use of pins between courses while minimizing setback to less than one inch between courses. The blocks of the present invention may be made in any variety of sizes to allow for use in either residential or commercial applications.

The first aspect of the present invention is composite masonry block having a substantially rectangular six-sided body. The block body has a bevelled surface lying between the back surface and the upper surface of the block which spans the width of the block and is oriented at an angle less than 90 degrees in relation to the upper surface. The block also has a flange extending from the back surface of the block and spanning the width of the block which is cast to fit and interlock with the bevelled edge of an adjacent block. Structures, including retaining walls, constructed of the composite block of the present invention are also disclosed.

The second aspect of the present invention is a method of block molding a composite masonry block on its side which includes filling a block mold with mix by introducing mix into the open upper end of the block mold and casting a block on the blocks side by compressing the mix in the mold through the application of pressure to the exposed mix at the open upper end of the block mold.

BRIEF DESCRIPTION OF THE DRAWINGS

FIG. 7 is a cut-away view of the wall shown in FIG. 6 taken along line 7—7.

FIG. 8 is a schematic depiction of one embodiment of the method of the present invention.

FIG. 9 is a top plan view of a filled mold used in accordance with the method of the present invention.

DESCRIPTION OF THE PREFERRED EMBODIMENTS

Accordingly, the present invention provides a composite masonry block, the process for making this block, and structural elements such as retaining walls made from this block. The process of the present invention economically provides a block having a high structural integrity which, when the block is molded on its side allows for the definition of certain structural elements on the block, i.e. the flange and bevel, which when placed in use provide for the construction of a retaining wall having minimal set back and not requiring the use of pins, stakes, or other securing means.

Composite Masonry Block

Figure 1:
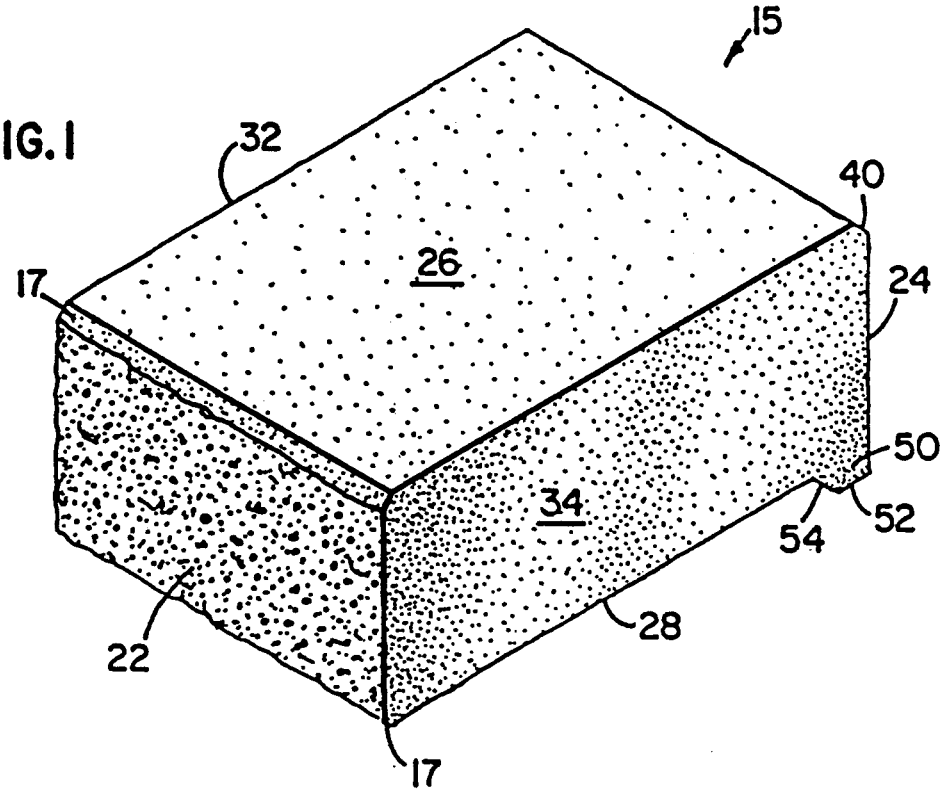
FIG. 1 is a perspective view of one embodiment of a composite masonry block made in accordance with the method of the present invention.
Figure 2:
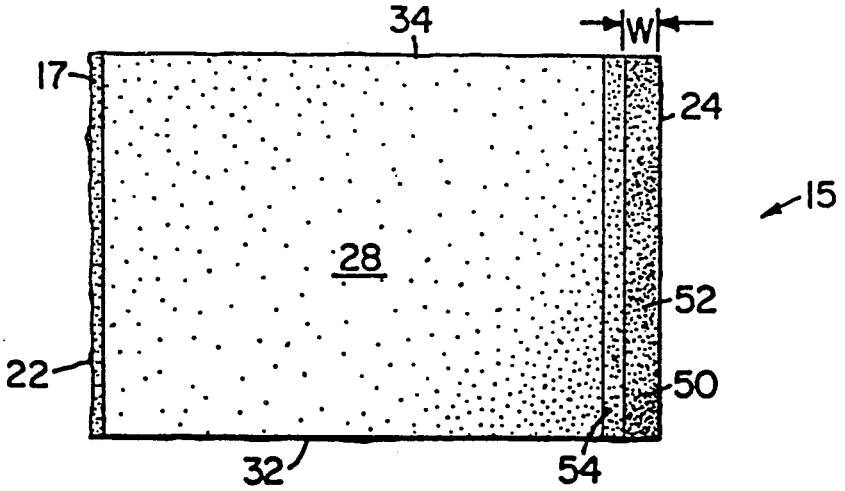
FIG. 2 is a bottom plan view of the composite masonry block shown in FIG. 1.
Figure 3:
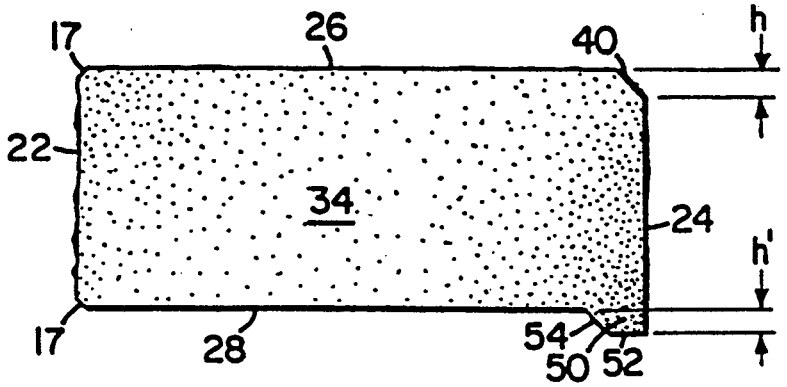
FIG. 3 is a side plan view of the composite masonry block shown in FIG. 1.

Referring to the drawings wherein like numerals represent like parts throughout several views, a composite masonry block 15 is generally shown in FIGS. 1–3. This first aspect of the present invention is a composite masonry block having a substantially rectangular body with a front surface 22 and a back surface 24 separated by the depth of the block. The block also has an upper surface 26 and lower surface 28 separated by the height of the block. The upper and lower surfaces are bordered by and lie adjacent to the front 22 and back 24 surfaces. Finally, the block has first 32 and second 34 side surfaces separated by the width of the block. The first and second side surfaces each are substantially rectangular. The block also has a bevelled surface 40 lying between and connecting the back surface 24 and the upper surface 26. The bevelled surface 40 spans the width of the block 15 and is oriented at an angle less than 90 degrees in relation to the upper surface.

The block also has a flange 50 extending from the back surface 24 of the block and spanning the width of the block. The flange includes a base surface 52 and an interlocking surface 54. The interlocking surface lies between and adjacent to the block's lower surface 28 and the flange base surface 52 and is oriented at an angle which is substantially similar to the angle of the bevelled edge 40. The flange base surface 52 generally has a width, w, which, when h′ equals h′, correlates to the setback distances between courses, FIGS. 2 and 3. When h′ does not equal h the setback between courses may be determined by any number of factors including the difference in the length of the upper surface 26 and the length of the lower surface 28 and the angle of the bevelled edge 40 and the locking surface 54.

The first element of the composite masonry block is the body of the block 15. The block's body provides weight and physical structure to the system in which the block is used. Landscaping elements such as retaining walls often must be constructed of units which not only provide a structural impediment to resist the natural flow of soil, but must also provide the shear weight to withstand these forces. Moreover, the body of the block functions to provide the supporting surfaces which may be used to seat an aesthetically pleasing pattern such as that found on the front surface 22 of the block, FIG. 1. Finally, the body of the block of the present invention provides a substrate for holding elements which help form an interlocking matrix with other blocks when used in a structure such as a wall. In particular, the block carries a bevelled edge 40 and flange 50 which assists in the interlocking function of the block.

Generally, the block may take any number of shapes in accordance with the present invention. Preferably, the block will retain the shape of an elongated or rectangular cube 15, FIG. 1. As can be seen, the block generally has at least six surfaces. The front surface 22 which will face outward from the wall may either be plain or contain a roughened block appearance to enhance its aesthetic appeal. The front surface 22 may be smooth or coarse, planar or curved, as well as single-faceted or multi-faceted. The back surface 24 lies parallel to, and opposite the front surface 22 across the depth of the block 15. The top surface 26 of the block 26 lies parallel to and across the height of the block from the bottom surface 28. It can be seen the upper surface 26 has a greater depth than the lower surface 28. This difference in depth along with the angle of the bevelled edge 40 and the locking surface 54 contribute to the setback between courses. The block also has a first and second side surface, 32 and 34 respectively, which again lie parallel to each other across the width of the block.

In its most preferred mode, the block of the present invention is suitable for residential use by homeowners, handymen and the like for use in building landscape structures. In this instance, the block generally weighs from about 15 lbs. to 50 lbs. and has a height of about 4 to 6 inches, a width of 7 to 10 inches, and a length of about 10 to 14 inches.

Lying between the upper surface 26 and the back surface 24 is a bevelled edge 40, FIGS. 1 and 3. The bevelled edge provides one element of the system which allows the interlocking adjoinment of a number of composite masonry blocks to provide landscape structures. This bevelled edge 40 facilitates the provision of a smaller block having minimal setback while providing a complementary interlocking flange 50 which has high structural integrity. Specifically, by allowing for edge 40, material is removed from a portion of the block having high structural strength. Meanwhile, in order to provide a complementary surface, material is added to the flange 50 to create surface 54.

Generally, the bevelled edge 40 may take any number of shapes or forms. Preferably, the bevelled edge is planar and lies between and adjoins to the upper surface 26 of the block, and the back surface 24 of the block, FIG. 3. Alternatively, the bevelled edge 40 may have an arcing surface as opposed to a planar surface. In this embodiment the arc of the bevelled edge substantially matches the arc of the angled locking surface. This bevelled edge 40, generally has an angle less than 90 degrees in relationship to the block upper surface 26 and back surface 24. The bevelled edge 40 spans the entire width of the block to assist in providing an interlocking network of blocks 15 which may either be stacked in linear fashion or offset.

For example, the composite masonry blocks may either be registered or offset. Offsetting blocks, especially when used in the construction of a retaining wall, assists in defining a wall having a higher structural stability, see FIG. 4. The use of a bevelled edge 40 which runs the entire width of the block allows for the random or offset base of a flange 50, FIG. 3, of another block on top of the first block. Accordingly, any variety of offset patterns are possible with the block of the present invention.

Complementing the bevelled edge 40 of the brick of the present invention is a flange 50 extending downward from the back surface 24 of the block, FIG. 2. The flange 50 and the bevelled edge 40 provide an effective interlocking and a setback minimizing mechanism which stabilizes structures made in accordance with the present invention. Moreover, in the present invention, the setback is not equal to the width of the flange in the plane of the lower surface.

The flange used on the block of the present invention has an added thickness resulting from at least one angled surface adjoining the lower surface 28 of the block and the extending back surface 24 of the block. The flange 50 provides minimal setback 28 for the block and through the bevelled edge 40 and an angled surface on the flange 50, the flange may comprise as much as twice the concrete as a flange which has a geometry which is normal to the lower surface 28 of the block 15. The added material used in forming the flange adds to the strength of the flange and thereby overcomes the problems of designing a smaller functional block having structural elements which allow the construction of a strong structure such as a wall without excessive setback.

Generally, the flange 50 used in the block of the present invention may comprise the extended surface of the blocks rear surface 24 and an angled surface which locks the block in place. The angled surface may adjoin the edge of the rear surface 24 and the block lower surface 28 lying between these two planes. While the angled "locking surface" may have any angle between 0° and 90° in relation to the block lower surface, the locking surface must have substantially the same angle as the bevelled edge in relation to the blocks lower surface 28. Following, from the flanges 50 principal function of providing optimum strength with minimum setback, the angle of the locking surface in relation to the block's lower surface 28 is preferably less than 90°, more preferably from about 30° to 60°, and most preferably from about 40° to 50°.

In one preferred embodiment of the present invention, FIG. 3, the block flange has a locking surface 54 which is substantially planar and adjoins the blocks lower surface 28 and the flange base surface 52 lying therebetween. The flange locking surface 54 spans the width of the block to allow the offset placement of blocks.

Preferably, as can be seen in FIG. 3, the flange may comprise an optional base surface 52 and a locking surface 54. These surfaces may take on any number of different height, depth, and width aspects in accordance with the present invention in order interlock the blocks 15 in place and provide a stable retaining wall or other landscape structure.

As can be seen in this preferred embodiment, the flange 50 extends from the back surface 24 of the composite block 15 and the base surface 52 is parallel to but below the plane of the lower surface 28 of the block. The base surface 52 runs the width of the block and adjoins the back surface 28 of the block through a common edge. The width, w, FIG. 2 of the base surface 52 determines the amount of setback from one course to the next higher course when the height of the bevelled edge 40, h, equals the height of the flange 50, h', FIG. 3. Preferably, w is generally less than 2 inches and more preferably less than about one inch providing a block which not only seats properly due to its inherent mass, but also sets back less than about one inch from one course to the next higher course, FIGS. 4–7.

Figure 4:
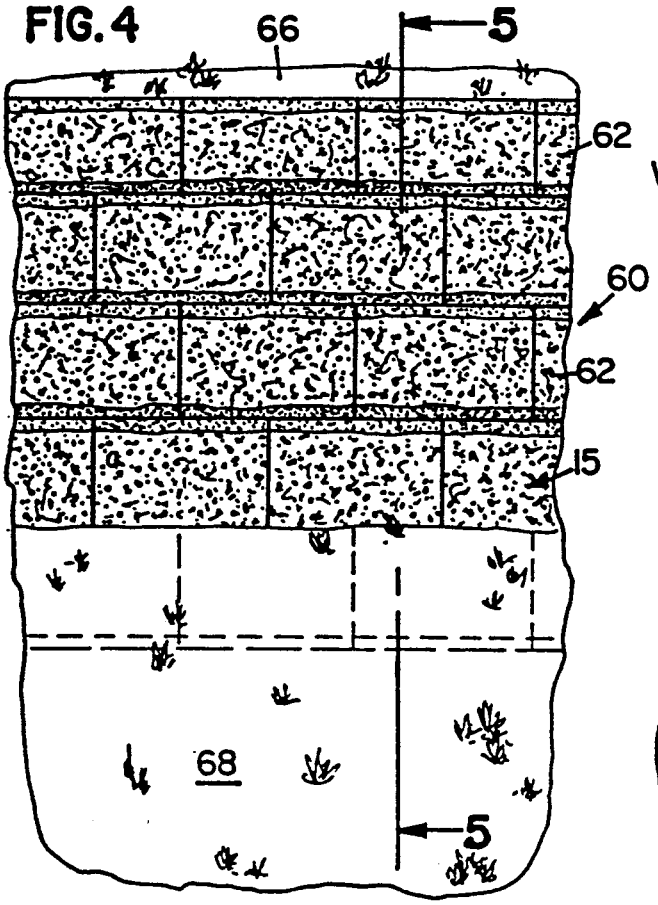
FIG. 4 is a perspective view of a retaining wall constructed with one embodiment of the composite masonry block of the present invention.

The composite masonry block 15 of the present invention may be used to build any number of landscape structures. Examples of the structures which may be constructed with the block of the present invention are in FIGS. 4–7. As can be seen in FIG. 4, the composite masonry block of the present invention may be used to build a retaining wall 60 using individual courses 62 to construct the wall to any desired height. As can be seen setback between the courses is again measured by w, FIG. 5. Regardless of the angle and height of the bevelled edge 40 and the flange 50 and flange locking surface 54, the block of the present invention may provide setback of less than about 2 inches and more preferably less than about one inch. The blocks may be stacked in an even pattern or an offset pattern depending on the intended application.

Figure 5:
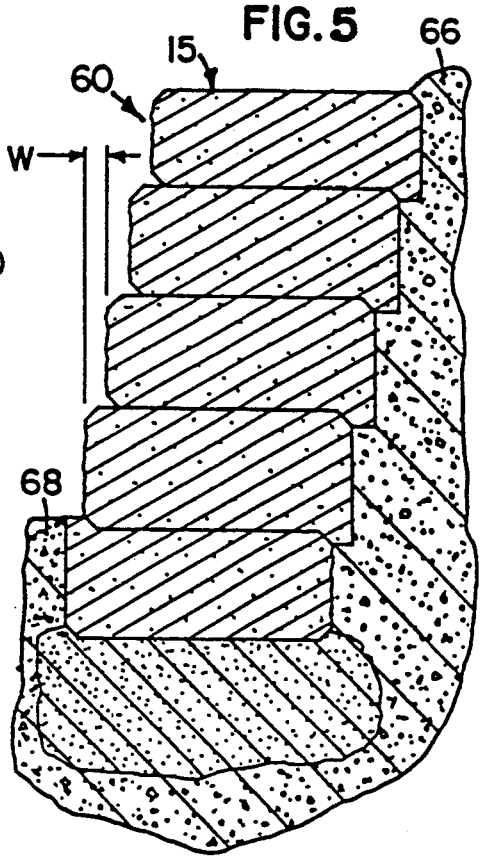
FIG. 5 is a cut-away view of the wall shown in FIG. 4 taken along line 5—5.

Generally, construction of a structure such as a retaining wall is undertaken by first defining a trench area beneath the plane of the ground in which to deposit the first course of blocks, FIG. 5. Once defined, the trench is partially refilled and tamped or flattened. The first course of blocks is then laid into the trench. The first course of blocks may often comprise blocks which are laid on their back in order to define a pattern or stop at the base of the wall. As can be seen in FIGS. 4–7, successive courses of blocks are then stacked on top of the other while backfilling 66 the wall. As stability is dependent upon weight and minimal setback, the minimal setback provided by the blocks of the present invention assists in further stabilizing even lighter weight blocks. This minimal setback adds to the stability of smaller size blocks by slowing the horizontal movement backward of the wall through the addition of successive courses.

Figure 6:
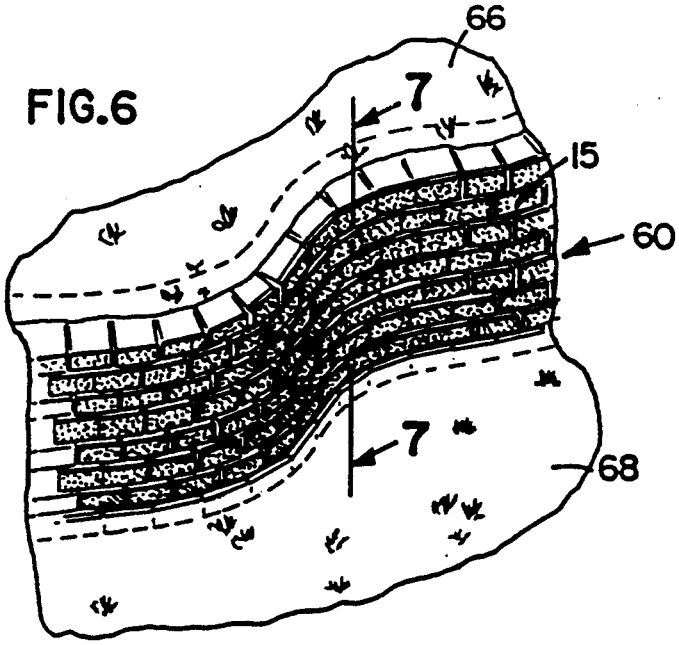
FIG. 6 is a partially cut-away perspective view of a retaining wall constructed with one embodiment of the composite masonry block of the present invention showing the structure of the wall below the ground.

The blocks of the present invention also allow for the production of convex or concave walls, FIG. 6. The blocks may be placed at an angle to one another so as to provide a serpentine pattern having convex and concave surfaces. Shown in FIG. 7 is a cutaway of this wall. In this instance, a trench is again formed in the earth. The first course of the wall is seated in the trench and will be under soil once the wall is backfilled. A cross section of the wall depicted in FIG. 6 is shown in FIG. 7. The blocks 15 are placed on a securing mat or matrix 70 which is secured within the bank 66 by deadheads 72. The deadheads 72 serve as an additional stabilizing factor for the wall providing additional strength. The deadheads 72 may be staggered at given intervals over the length of each course and from course to course to provide an overall stability to the entire wall structure. Additionally, the blocks of the present invention may be easily split to create any variety of structures such as 90° corners in retaining walls etc.

Block Molding the Blocks

An additional aspect of the present invention is the process for casting or forming the composite masonry blocks of this invention. Generally, the process for making this invention includes block molding the composite masonry block on its side, by filling a block mold with mix and casting the block on its side by compressing the mix in the mold through the application of pressure to the exposed mix at the open upper end of the block mold.

Formation or casting of the block in accordance with the present invention takes place on the block side. Formation of the block on its side eliminates contact and thus adhesion between the wet fill used to form the flange and the wet surfaces of the mold-and compressive head. This process is especially useful when the intended block has smaller elements requiring high definition on the blocks upper or lower surface. As a result, the wet fill of the smaller elements has no opportunity to contact or adhere to the wet surface of the head, which would otherwise pull the element from the block upon release of the head. Details such as the interlocking flange 50 may be defined in a way which provides for minimal structural size.

As elements such as the interlocking flange 50 are not subjected to the direct compressive force of the head, adhesion between the wet fill comprising the flange and the wet compressive head does not occur. As a result, the process of the present invention allows for the definition of interlocking flanges having a minimal size yet high structural integrity. In turn, the minimal size of the interlocking flange provides for minimal set back when the blocks are used to form successive stacks of courses towards the construction of a wall or other structure. Casting of the block of the present invention on its lower surface or upper surface would not allow for the formation of a flange and bevelled edge having the structural integrity of blocks produced by the methods of the present invention.

An outline of the process can be seen in the flow chart shown in FIG. 8. Generally, the processes is initiated by mixing the concrete fill. Any variety of concrete mixtures may be used with this invention depending upon the strength, water absorption, density, and shrinkage among other factors desired for the given concrete block. One mixture which has been found to be preferable includes cement, fly ash, water, sand, and gravel or rock. However, other components including plasticizers, water proofing agents, cross-linking agents, dyes, colorants, pigments etc. may be added to the mix depending upon the physical characteristics which are desired in the resulting block.

Blocks may be designed around any number of different physical properties in accordance with ASTM Standards depending upon the ultimate application for the block. For example, the fill may comprise from 75 to 95% aggregate being sand and gravel in varying ratios depending upon the physical characteristics which the finished block is intended to exhibit. The fill generally also comprises some type of cement at a concentration ranging from 4% to 10%. Other constituents may then be added to the fill at various trace levels in order to provide blocks having the intended physical characteristics.

Generally, once determined the fill constituents may be placed in any number of general mixers including those commonly used by those with skill in the art for mixing cement and concrete. To mix the fill, the aggregate, the sand and rock, is first dumped into the mixer followed by the cement. After one to two and one-half minutes, any plasticizers that will be used are added. Water is then introduced into the fill in pulses over a one to two minute period. The concentration of water in the mix may be monitored electrically by noting the resistance of the mix at various times during the process. While the amount of water may vary from one fill formulation to another fill formulation, it generally ranges from about 1% to about 6%.

Once the fill is mixed, the fill is then loaded into a hopper which transports the fill to the mold 80 within the block machine, FIG. 9. Fill is placed in the mold cavities in a manner which provides for casting the blocks on their sides. The mold 80 may produce a single block or, as can be seen in FIG. 9, a plurality of blocks through cavities which provide for the joint formation of any number of blocks. The mold cavities 81 provide form the specific definition of the block flange 50 by area 50'. While the mold shape is critical, any block machine known to those of skill in the art may be used. One machine which has been found useful in the formation of blocks in accordance with the present invention is a Besser V-3/12 block machine.

Once the mold has been filled, leveled by means such as a feed-box drawer, and agitated, a compression mechanism such as a head converges on the exposed surface of the fill. The head acts to compress the fill within the mold for a period of time sufficient to form a solid contiguous product. The head, as known to those of skill in the art, is a unit which has a pattern which mirrors the blocks and mold cavities 81 and is complementary to that of the mold 80. Generally, the compression time may be anywhere from ½ to 2 seconds. Once a compression period is over, the head in combination with an underlying pallet acts to strip the blocks 15 from the mold 80. At this point in time, the blocks are formed.

Prior to compression the mold may be vibrated. Generally, the fill is transported from the mixer to a hopper which then fills the mold 80. The mold is then agitated for up to two or three seconds, the time necessary to ensure that the fill has uniformly spread throughout the mold. The blocks are then formed by the compressing action of the head.

Once the blocks are formed, they may be cured through any means known to those of skill in the art. Curing mechanisms such as simple air curing, autoclaving, steam curing or mist curing, are all useful methods of curing the block of the present invention. Air curing simply entails placing the blocks in an environment where they will be cured by the open air over time. Autoclaving entails placing the blocks in a pressurized chamber at an elevated temperature for a certain period of time. The pressure in the chamber is then increased by creating a steady mist in the chamber. After curing is complete the pressure is released from the chamber which in turn draws the moisture from the blocks.

Another means for curing blocks is by steam. The chamber temperature is slowly increased over two to three hours and then stabilized during the fourth hour. The steam is gradually shut down and the blocks are held at the eventual temperature, generally around 120°-200° F. for two to three hours. The heat is then turned off and the blocks are allowed to cool. In all instances, the blocks are generally allowed to sit for twelve to twenty-four hours before being stacked or stored. Critical to curing operations is a slow increase in temperature. If the temperature is increased too quickly, the blocks may "case-harden." Case-hardening occurs when the outer shell of the blocks hardens and cures while the inner region of the block remains uncured and moist.

Once cured, the blocks may be split if they have been cast "siamese" or in pairs. Splitting means which may be used in the method of the present invention include a manual chisel and hammer as well as machines known to those with skill in the art for such purposes. Splitting economizes the production of the blocks of the present invention by allowing the casting of more than one block at any given time. Moreover, combined casting of the blocks allows for the formation of an aesthetic front surface 24 which is somewhat irregular. When cast in pairs, the blocks 15, FIG. 9, may be cast to have an inset groove 17 on their upper and lower surfaces between their two blocks. This groove 17 has a dual function of enhancing the aesthetic appeal of the blocks as well as providing a natural weak point or fault which facilitates the splitting action. Once split, the blocks may be cubed and stored. The blocks may be split in a manner which provides a front surface 22 which is smooth or coarse, single-faceted or multi-faceted, as well as planar or curved.

The above discussion, examples, and embodiments illustrate our current understanding of the invention. However, since many variations of the invention can be made without departing from the spirit and scope of the invention, the invention resides wholly in the claims hereinafter appended.

I claim as my Invention:

1. A composite masonry block suitable for use in the construction of substantially vertical mortarless retaining walls comprising:

(a) a block body having generally planar, generally parallel, spaced top and bottom surfaces, a pair of spaced side surfaces, each side surface intersecting the top and bottom surfaces, and front and rear surfaces at opposite ends of the block body; and (b) means for interlocking and automatically setting back successive courses of said block comprising a rearwardly-facing bevelled surface extending the width of the block and intersecting the top and rear surfaces of the block body at angles of less than 90 degrees and a flange extending the width of the block body and also extending downwardly from the rear and bottom surfaces of the block body and including a forwardly-facing locking surface extending the width of the block body and intersecting the bottom surface of the block body, said locking surface being substantially parallel to said bevelled surface, wherein the horizontally-measured thickness of the flange in the plane of the bottom surface is greater than the predetermined set back distance, thus providing for minimal setbacks, and resulting substantially vertical walls, while at the same time providing strength in the flange so that it may withstand the loading on the wall, as well as resist damage during packing, shipping, handling and installation; and wherein (c) the line of intersection of the bevelled surface with the top surface of the block body is displaced rearwardly on the block body with respect to the line of intersection of the locking surface with the bottom surface of the block body, whereby a second course of blocks made according to this invention, when placed upon a first course of such blocks so that the locking surfaces of the blocks of the second course seat upon the bevelled surfaces of the blocks of the first course, will be automatically set back from the first course by a predetermined distance, and will be interlocked with the first course of blocks so as to resist the loading on the rear surfaces of the wall caused by earth and water retained therebehind.

2. The composite blocks of claim 1, wherein (a) the distance between the top and bottom surfaces of the block body is from about four to about six inches;

(b) the sides of the block body are generally planar and substantially parallel and are from about seven to about ten inches apart;

(c) the front and rear surfaces of the block body are generally planar and substantially parallel and are from about ten to about fourteen inches apart; and (d) the block weighs between about fifteen and about fifty pounds.

3. The composite block of claim 1, wherein said flange comprises a base surface, generally parallel to said top and bottom surfaces, spanning the width of the block and adjoining said locking surface and said rear surface and lying therebetween.

4. The composite block of claim 1 wherein said composite elements comprise sand, stone and cement.

5. The composite block of claim 1, wherein said locking surface and said bevelled surface arc to substantially the same degree.

6. The composite block of claim 3, wherein said base surface has a width of less than one inch.

7. The composite block of claim 3, wherein said base surface has a width of about three-quarters of an inch.

8. The composite block of claim 1 wherein said front surface is coarse.

9. The composite masonry block of claim 1, wherein the angle of the bevelled surface and the flange locking surface comprises an angle of from about 30 degrees to about 60 degrees in relation to the top surface of the block body.

10. The retaining wall block of claim 1, wherein the predetermined setback between courses comprises from about 0.5 inches to about 1.5 inches.

11. The retaining wall block of claim 1 wherein the predetermined setback between courses comprises less than about one inch.

12. The retaining wall block of claim 1, wherein the predetermined setback between courses comprises about three quarters of an inch.

* * * * *